United States Patent [19]

Kawabe

[11] 4,442,849

[45] Apr. 17, 1984

[54] CURLING IRON

[75] Inventor: Shinichi Kawabe, Fukuoka, Japan

[73] Assignee: Idea Giken Ltd., Fukuoka, Japan

[21] Appl. No.: 326,860

[22] Filed: Dec. 3, 1981

[30] Foreign Application Priority Data

| | | | |
|---|---|---|---|
| Dec. 9, 1980 | [JP] | Japan | 55-174296 |
| Dec. 26, 1980 | [JP] | Japan | 55-188008 |
| Mar. 3, 1981 | [JP] | Japan | 56-30672 |

[51] Int. Cl.[3] ..... A45D 2/12

[52] U.S. Cl. ..... 132/37 R; 132/9

[58] Field of Search ..... 132/31 R, 32 R, 34 R, 132/37 R, 9, 31 A, 34 A, 37 A; 219/221-226, 230, 533; 81/315, 428 R

[56] References Cited

U.S. PATENT DOCUMENTS

| | | | |
|---|---|---|---|
| 485,370 | 11/1892 | Brooks | 81/313 |
| 563,785 | 7/1896 | Morley | 132/34 R |
| 2,797,692 | 7/1955 | Lenzi | 132/34 R |
| 4,130,122 | 12/1978 | Kennedy | 132/34 R |
| 4,329,567 | 5/1982 | Kunz et al. | 132/34 R |

FOREIGN PATENT DOCUMENTS

| | | | |
|---|---|---|---|
| 2242051 | 3/1975 | France | 219/225 |

*Primary Examiner*—C. Fred Rosenbaum
*Assistant Examiner*—Sherri E. Vinyard
*Attorney, Agent, or Firm*—McAulay, Fields, Fisher, Goldstein & Nissen

[57] ABSTRACT

A curling iron for curling or waving a lock of hair twined around a heated iron rod, wherein an iron rod/-clamping member assembly is mounted rotatably on the iron handle and mechanical or electrical means is provided for rotating the assembly to facilitate the curling or waving operation. Preferably, the iron rod/clamping member assembly is mounted detachably on a rotatable shaft housed within the iron handle to enable ready replacement of the assembly as well as angular positioning of the assembly with respect to the iron handle.

27 Claims, 29 Drawing Figures

CURLING IRON

This invention relates to an electric curling iron for curling or waving a lock of hair.

Hitherto, various improvements have been proposed for electric curling irons. Most of the prior efforts, however, have been directed to improving the cross-sectional configuration of the iron rod. Therefore, conventional curling irons have in common a classic scissor-like construction comprising an iron rod and bill-shaped clamping member which pivots with the iron rod for an opening and closing movement. The iron rod has been made integral with the iron handle, so curling has necessitated the manual rotation of the entire iron rod and clamping member assembly with a lock of hair clamped therein. Generally, one has to rotate the curling iron about 180° in curling, which is beyond the tolerable angle of rotation of the human wrist. With the foregoing construction, this rotation of the curling iron is customarily achieved by maximum rotation of the wrist in combination with rotation of the palm and assisted by the additional finger and elbow movements. Curling operations thus involve complex joint movements and are so cumbersome and fatiguing that considerable skill and experience are required to avoid irregular curling, bends, and slacks in the hair.

An object of the present invention is to provide a curling iron which is easy to manipulate even by an unskilled user and which can curl without rotational movement of the wrist, palm, or fingers.

Another object of the invention is to provide a curling iron with an iron rod/clamping member assembly which is detachably mounted to the iron handle so that the assembly may be replaced and may be positioned at any angle with respect to the iron handle.

Still another object of the invention is to provide a curling iron in which the direction of rotation of the iron rod is reversed at the discretion of the user so as to enable the direction of curl to be changed and enable one to curl or wave one's hair without the assistance of a second person.

The present invention provides a curling iron comprising a handle, an iron rod having a shaft mounted rotatably within said handle, a clamping member pivoted to said iron rod for an opening and closing movement with respect thereto for clamping a lock of hair against said iron rod, means associated with said clamping member for moving said clamping member, and means for rotating said shaft to twine a lock of hair to be curled around said iron rod. With this arrangement, the iron rod/clamping member assembly is rotated to perform curling merely by operating the rotating means, so that complex, skilled manipulation is avoided.

Preferably, said means for the rotating clamping member comprises a handle lever pivoted at an end thereof to the handle for movement between an inoperative position in which the other end thereof is remote from the handle and an operative position in which the other end comes close to the handle; a pinion mounted on the rotatable shaft; a rack bar connected to the other end of the handle for swinging movement about said pivot; and a return spring mounted between the handle and handle lever for biasing the handle lever toward its inoperative position, said rack bar being provided with teeth capable of meshing with the pinion as the handle lever is pressed down or squeezed to rotate the shaft with the iron rod/clamping member assembly connected thereto.

Preferably, the iron rod and rotatable shaft are made as separate members and the iron rod/clamping member is mounted detachably on the shaft by means of a clamping screw so that, at the discretion of the user, the assembly can be removed from the shaft for replacement or can be turned to adjust the angular position relative to the handle.

Other objects, features, and advantages of the present invention will become apparent from the following description in conjunction with the accompanying drawings, in which.

Figure 18:
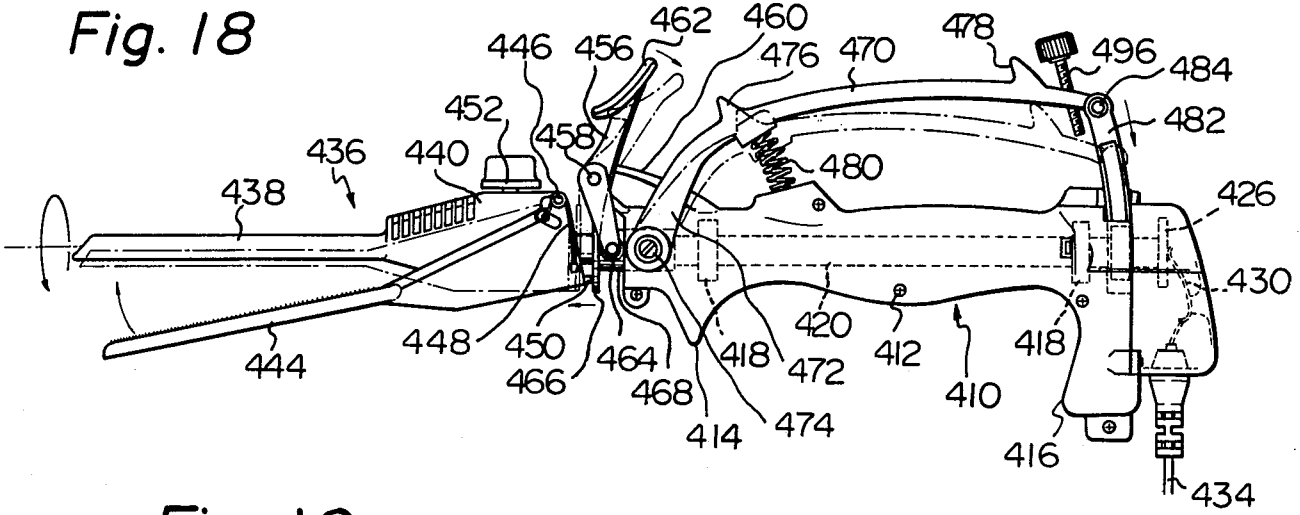
FIG. 18 is a front elevation of another embodiment.
Figure 19:
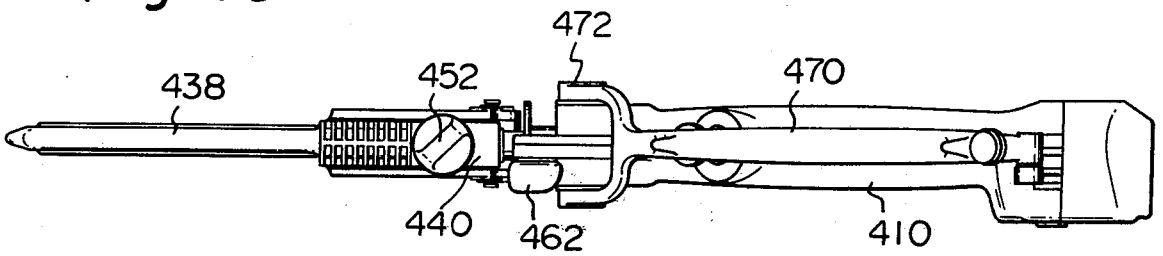
FIG. 19 is a top plan view of the embodiment shown in FIG. 18.
Figure 23A:
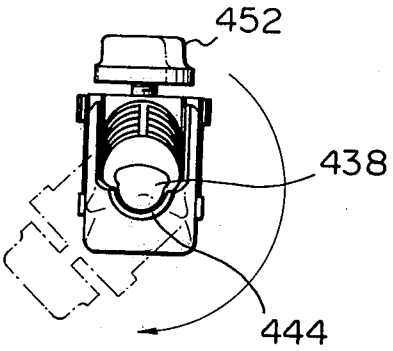
Figure 23B:
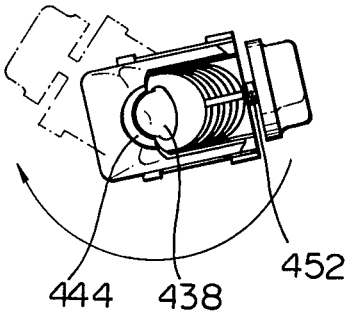
Figure 24:
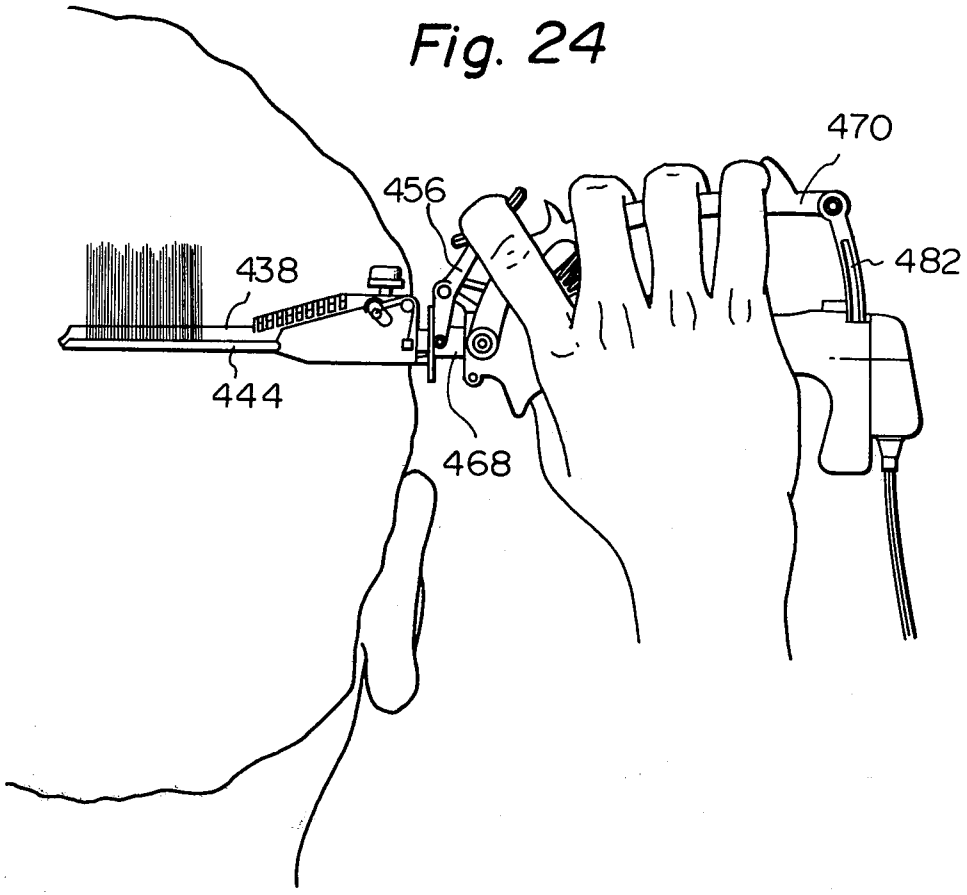
Figure 25:
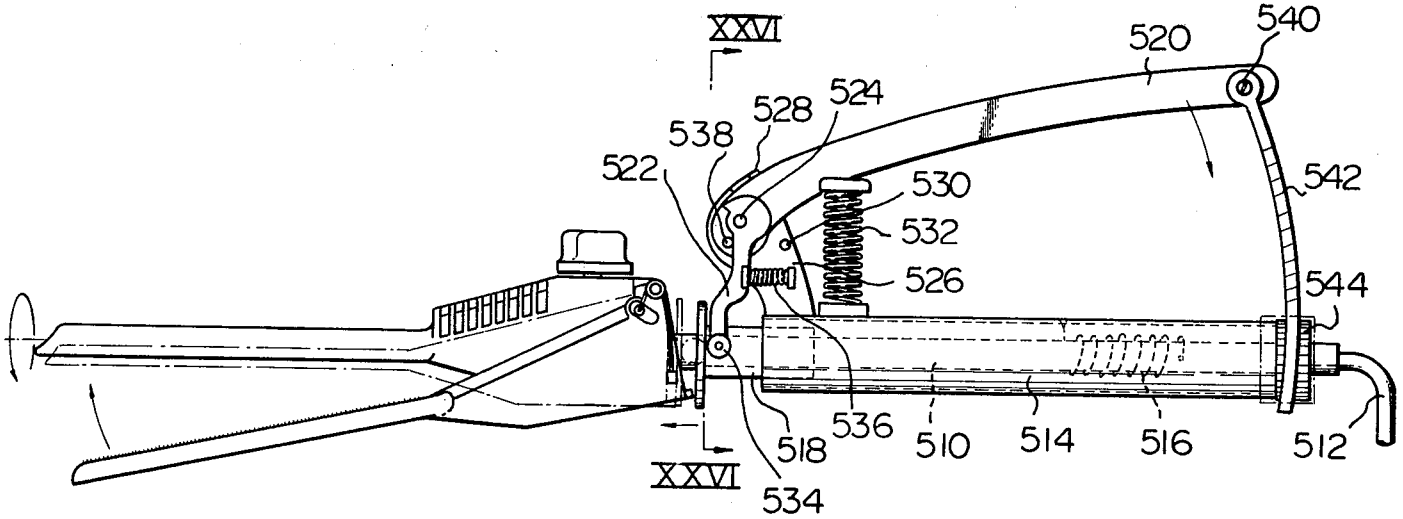
Figure 26:
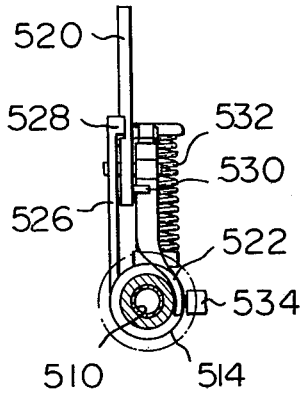
Figure 27:
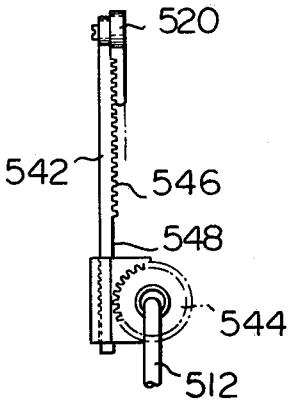
Figure 28:
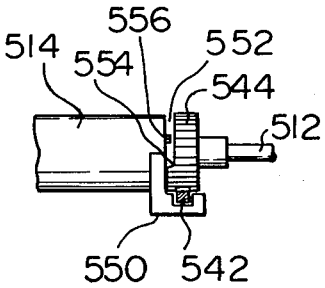

FIGS. 23*a* and 23*b* are views illustrating different angular positions of the iron rod/clamping member assembly;

FIG. 24 is a view illustrating the embodiment of FIG. 18 in use;

FIG. 25 is a front elevation of another embodiment;

FIG. 26 is a side elevation taken along the line XXVI—XXVI of FIG. 25;

FIG. 27 is an end elevation of the rack/pinion assembly of the embodiment of FIG. 25; and, FIG. 28 is a top plan view of a part of the embodiment of FIG. 25.

Figure 4:
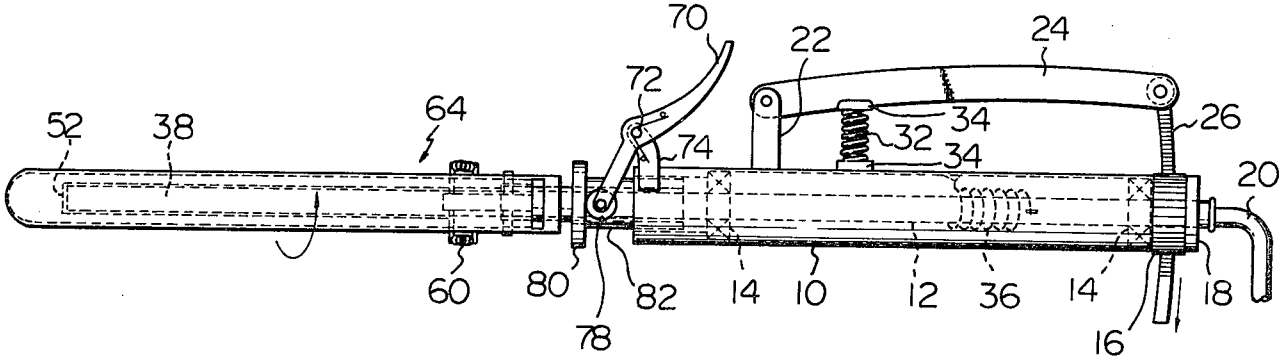
FIG. 4 is a front elevation of the embodiment in an operative position.
Figure 3:
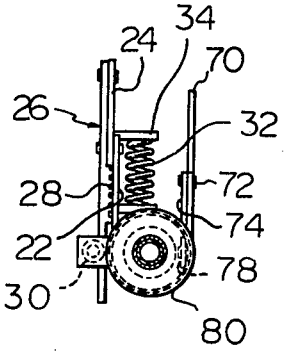
FIG. 3 is a side elevation taken along the line III—III of FIG. 1.

Referring now to FIGS. 1 through 4, there is shown an embodiment of the curling iron according to the invention which comprises a tubular handle 10 in which a hollow shaft 12 is rotatably mounted by a pair of bearings 14. The shaft 12 extends throughout the length of the handle 10 and projects beyond both ends of the handle. A pinion or spur gear 16 is closely fitted over the shaft 10 at the vicinity of the right-hand end thereof. An end cap 18 having a central aperture for passing an electric cord 20 therethrough is screwed onto the outermost end of the shaft 10. A support plate 22 is bonded or welded to the handle 10 at a side thereof, as best seen from FIG. 3. A handle lever 24 is pivoted at an end thereof to the support 22, the other end of the lever 24 being pivoted to a bow-shaped rack bar 26. The inner face of the rack bar 26 is provided throughout most of the length thereof with teeth 28 for meshing with the pinion 16, the lower portion of the inner face being left plain so as not to interfere or engage with the pinion. A guide roller 30, as illustrated in FIG. 3, mounted rotatably to the side of the handle 10 by a suitable bracket pushes the rack 26 toward the pinion 16 so that the teeth 28 thereof are brought into engagement therewith as the handle lever 24 is moved down by the action of the user's hand. A stop, not shown, may be provided at the lowermost end of the rack bar 26 to provide an abutment against the guide roller 30. A compression spring 32 is mounted between a pair of spring retainers 34 to bias the handle lever 24 back in the counterclockwise direction. As shown in FIG. 4, a torsion spring 36 is located around the rotary shaft 12 with one end secured to the shaft 12 and the other end to the handle 10. This torsion spring 36 serves to return the shaft 12 to its initial rest position, when the handle lever 24 is released upward, until the plain lower portion of the rack bar 26 faces the pinion 16 to disengage the teeth 28 from the pinion.

Figure 1:
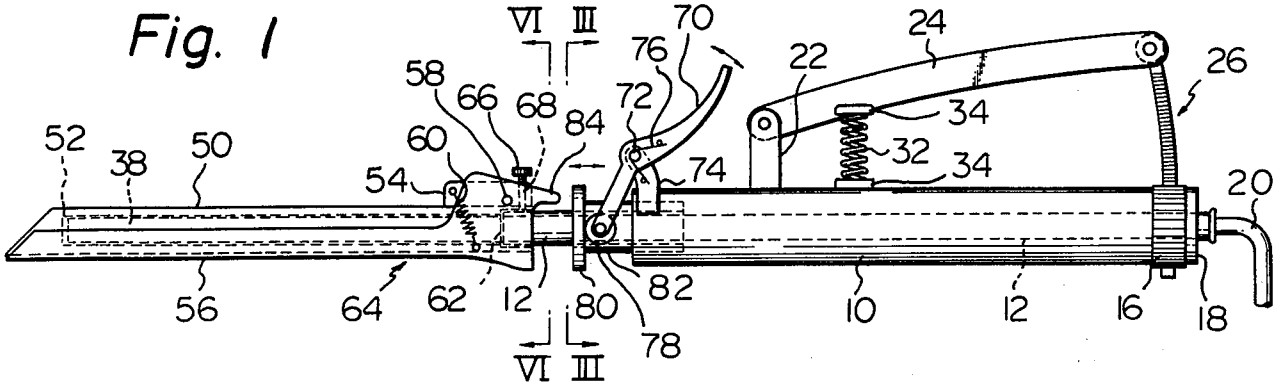
FIG. 1 is a front elevation of an embodiment of the invention in an inoperative position thereof.
Figure 2:
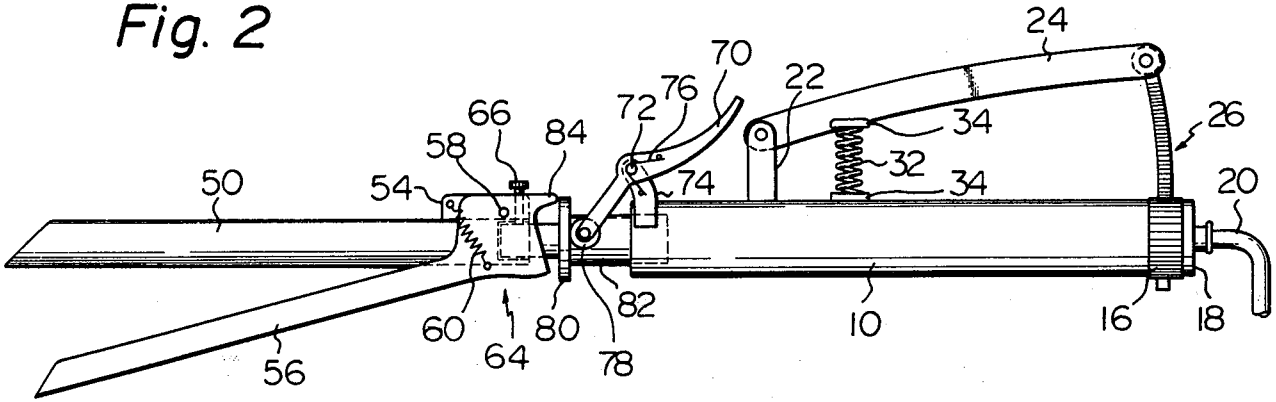
FIG. 2 is a front elevation of the embodiment of FIG. 1 and illustrating the clamping member in its open position.

The rotatable shaft 12 receives therein a heater tube 38 extending substantially throughout the entire length of the shaft and projecting toward the left, as viewed in FIG. 1, for a considerable length beyond the left-hand end of the shaft. The heater tube 38 has an electric heater wire, not shown, which is electrically connected to the cord 20 drawn into the rotatable shaft 12.

An iron rod 50 has an axially extending bore 52 for accommodating the heater tube 38 and is provided with an upright plate 54 to which a bill-shaped clamping member 56 is pivoted at 58. The clamping member 56 generally has a hemicyclic cross-section to conform with the outer configuration of the iron rod 50 and is normally biased toward the rod by means of coil springs 60. The iron rod 50 has a cylindrical recess 62 for receiving the end of the rotary shaft 12. The iron rod/-clamping member assembly 64 is detachably fastened to the shaft 12 by a screw 66 screwed into a threaded hole 68 of the plate 54. To control the opening and closing movement of the clamping member 56, an actuating lever 70 is pivoted at 72 to a support 74 secured to the side of the handle opposite the support 22. The actuating lever 70 is normally biased in the counterclockwise direction by a spring 76 and carries a roller 78 engagable with a flange 80 of a slidable sleeve 82 passed over the shaft 12. The flange 80 of the sleeve 82 has a diameter sufficient to engage with the prongs 84 provided at the end of the clamping member 56. The electric cord 20 is drawn through the aperture in the end cap 18 into the inside of the tubular shaft 12 to reach the heater element of the heater tube 38. The cord 20 may be electrically connected to the heater in any suitable manner known in the art.

Figure 5:
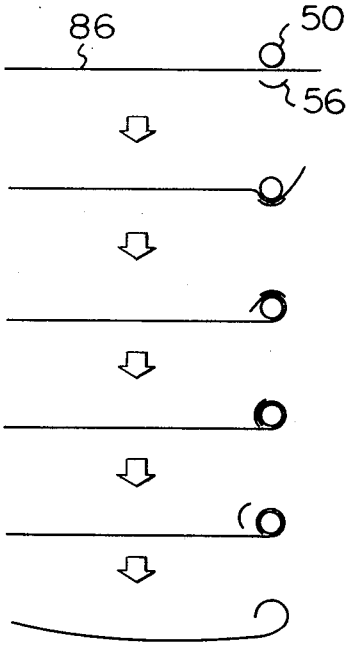
FIG. 5 is a view showing various stages of curling operations.

In use, the cord 20 is connected to a power source and the rod 50 is heated. The clamping member 56 is initially in its closed position due to the action of the spring 60, as illustrated in FIG. 1. As the user actuates the lever 70 with his or her finger, typically the forefinger, to move it in the clockwise direction against the action of the spring 76, the roller 78 is brought into engagement with the flange 80, which in turn is moved to the left to contact the prongs 84, whereby te clamping member 56 is rotated against spring action in the counterclockwise direction to become opened from and inclined with respect to the rod 50. In this position, a lock of hair 86 may be placed between the rod and clamping member as illustrated in FIG. 5. The user then releases his or her finger from the actuating lever 70 to allow it to be moved back in the counterclockwise direction under the action of the spring 76, so that the flange 80 is released from the prongs 84 of the clamping member 56. This enables the clamping member 56 to rotate back to its original position, thereby clamping the lock of hair against the rod. The user then grips the handle lever 24 and squeezes it to move the rack bar 26 downward until the teeth 28 mesh with the pinion 16. Further downward movement of the rack bar 26 guided by the guide roller 30, forces the pinion 16 to turn around to rotate the shaft 12 together with the iron rod/clamping member assembly 64 connected thereto, as shown in FIGS. 4 and 5. The smooth rotation of the rod/clamp assembly is assured at this moment because the slide sleeve 82 is retracted with its flange 80 disengaged from the prongs 84 of the clamping member. As the shaft 12 turns through a certain angle with a lock of hair clamping between the heated rod and clamping member, the hair is wound around the rod and is curled. After heat curling for several seconds, the lever 70 may be actuated to open the clamping member so that the curling iron as a whole can be moved away from the hair.

Figure 6:
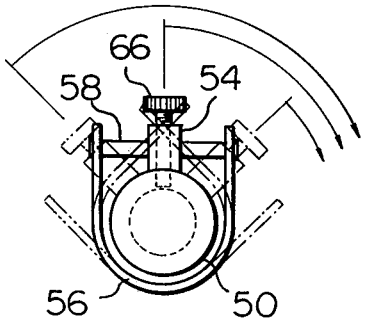
FIG. 6 is a side elevation taken along the line VI—VI of FIG. 1 and illustrating different angular positions of the iron rod/clamping member assembly.

For certain conditions of the user, such as the height of his or her head and the location of the lock of hair to be curled, it may be desirable to adjust the initial angular position of the rod and clamp assembly with respect to the iron body. According to the embodiment illustrated, this adjustment is possible by releasing the screw 66 to enable the assembly to be turned to the desired angle, as shown in FIG. 6. The screw is again fastened firmly after the assembly is placed at this new position. It will also be understood that, by detachably mounting the iron rod and clamping member assembly on the rotary shaft, it is possible to replace the assembly with another one having different dimensions and outer configuration.

FIGS. 7 through 11, show another embodiment of the invention. This embodiment is designed so that the opening and closing movement of the clamping member and the rotational movement of the iron rod are achieved by a single action of the handle lever. Further, the iron rod is made integral with the rotary shaft so that the iron rod and clamping member assembly is not detachable from the shaft. An iron rod 110 is mounted rotatably to a handle 112 by means of a pair of bearings 114 and is provided with a clamping member 116 which, in this case, is normally pushed by the spring 118 toward its open position. A slide sleeve 120 has two flanges 122 and 124, one of which is intended to engage with the prongs 126 located at the lower right-hand edge of the clamping member 116. An actuating lever 128 is pivoted to a support plate 130 together with a handle lever 132 by means of a common pivot 134. The actuating lever 128 has an angled end 136 to which a roller 138 is rotatably mounted. A compression spring 140 is held between a pair of spring retainers mounted one at the actuating lever 128 and the other at the support 130. The clockwise movement of the actuating lever 128 is limited by a stop 142 secured to the handle lever 132. The rotational movement of the handle lever 132 is limited by stops 144 and 146 provided on the support plate 130. A release lever 148 is pivoted at 150 to the handle lever 132 in such a manner that an end 152 thereof engages a recess formed on the actuating lever 128. As is schematically shown by a chain-line block in FIGS. 7 and 8 and as is more clearly illustrated in FIGS. 10 and 11, a rack bar 154 is adapted to be guided within a groove formed in a retainer 156 secured to the handle 112.

Figure 7:
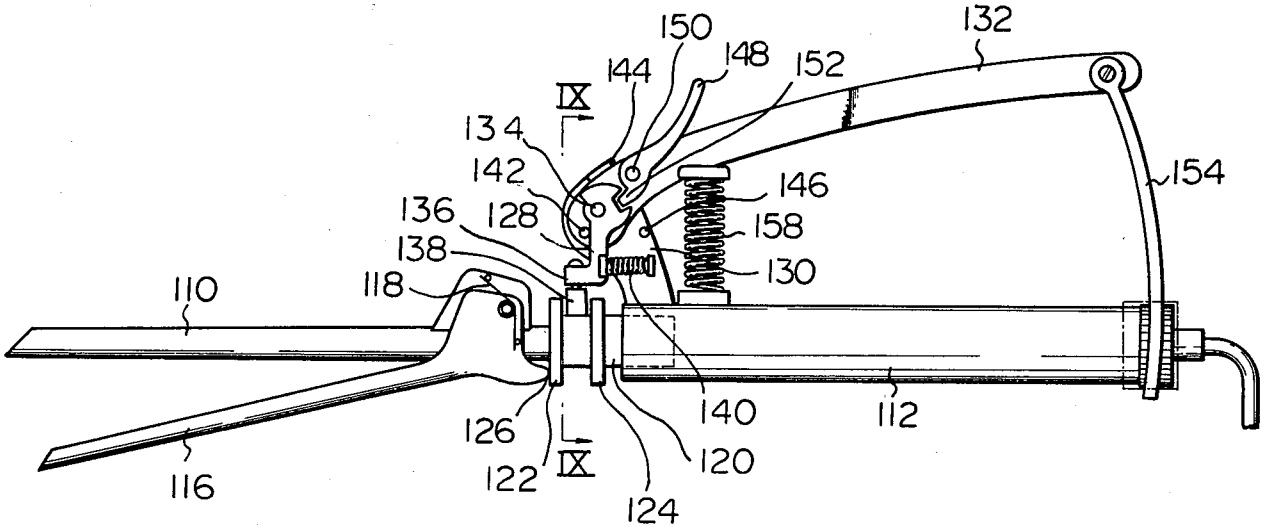
FIG. 7 is a front elevation of another embodiment in an inoperative position.

In the rest position of the curling iron, the handle lever is pushed upward by the spring 158 to abut against the stop 144, as shown in FIG. 7. In this position, the stopper pin 142 contacts the actuating lever 128 to push it counterclockwise against the action of the spring 140, so that the roller 138 engages the flange 124 of the sleeve 120 causing it to move toward the right, whereby the other flange 122 disengages from the prongs 126. As a result, the clamping member 116 is opened under the action of the spring 118.

Figure 8:
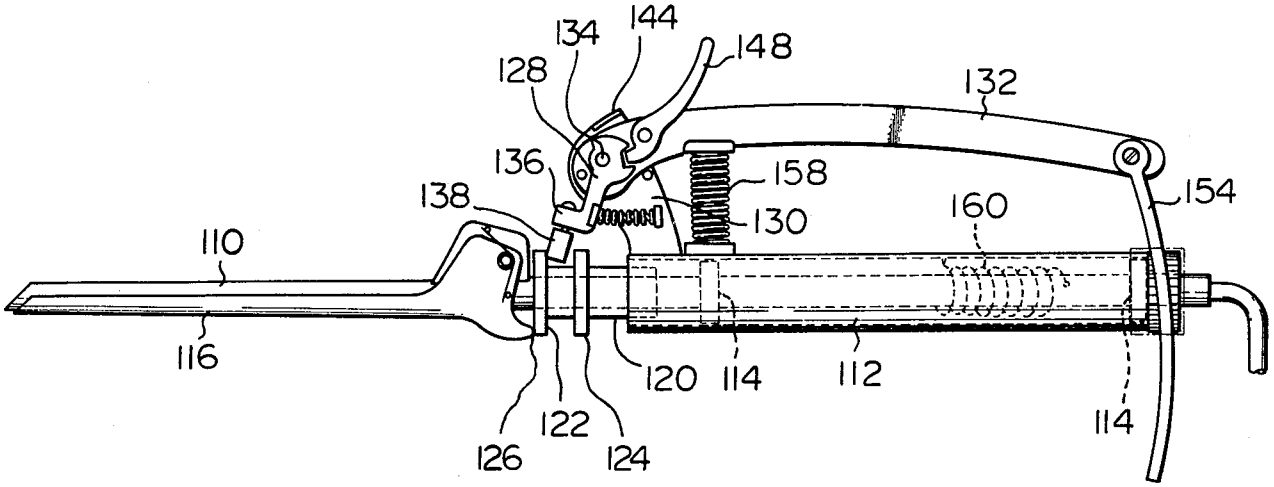
FIG. 8 is a view similar to FIG. 7 but showing the embodiment in an operative position.
Figure 9:
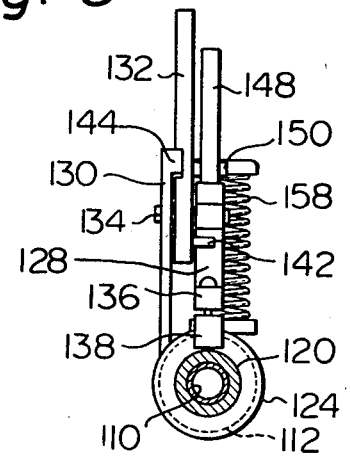
FIG. 9 is a side elevation taken along the line IX—IX of FIG. 7.
Figure 10:
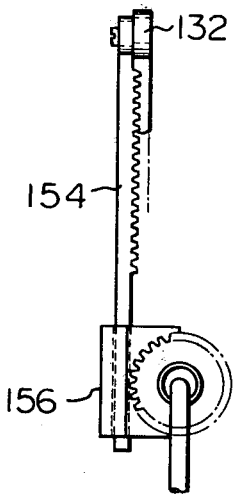
FIG. 10 is an end view of the embodiment of FIG. 7 illustrating the rack/pinion mechanism.
Figure 11:
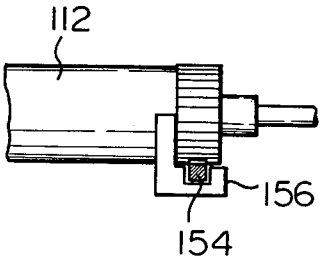
FIG. 11 is a top plan view of a part of the embodiment of FIG. 7.

In operation, a lock of hair is placed between the iron rod and the clamping member, and the handle lever is pressed down. As the handle lever effects a small angle of turn during its initial movement, the stop 142 rotates clockwise to allow the actuating lever to turn in the same direction by the spring action so that the flange 122 is brought into engagement with the prongs 126 to urge it clockwise, thereby closing the clamping member 116. As the handle lever is moved further, the teeth on the rack bar mesh with the pinion causing the iron rod and clamping member assembly to turn as shown in FIG. 8 with a lock of hair clamped therein. After curling, it is possible to open the clamping member by actuating the release lever 148 to move the actuating lever counterclockwise. The pressure exerted on the handle lever is then released, allowing the iron rod to turn in the reverse direction under the action of the spring 158 and the torsional spring 160. Finally, the stop 142 is brought into contact with the actuating lever 128 to move it in the counterclockwise direction, causing the slide sleeve to disengage from the prongs 126, whereby the clamping member is separated from the iron rod and is ready for the next curling operation.

Figure 12:
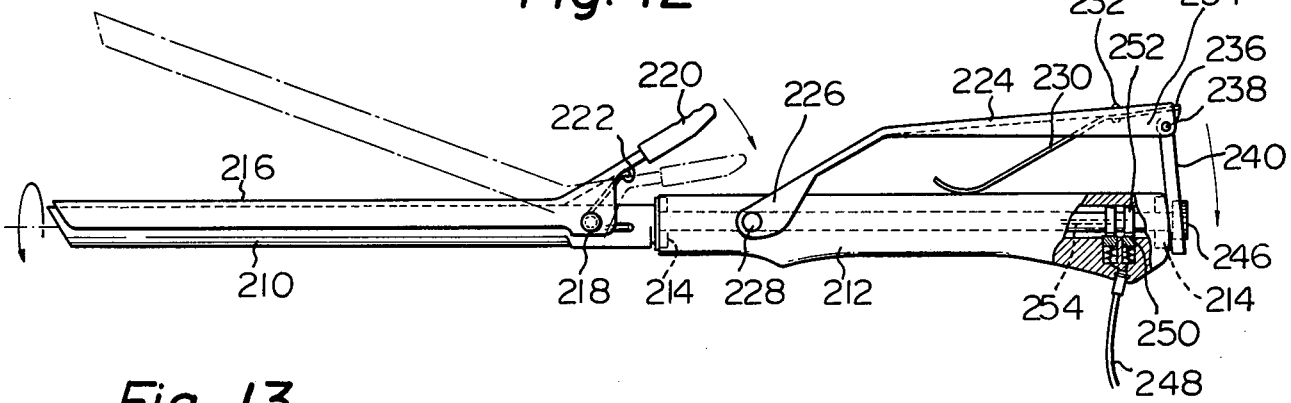
FIG. 12 is a partly cut away front elevation of a further embodiment.
Figure 13:
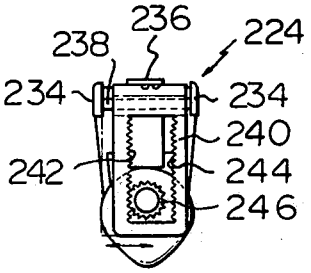
FIG. 13 is an end view of the embodiment of FIG. 12.

FIGS. 12 and 13 illustrate a further embodiment of the curling iron according to the invention. An iron rod 210 having an embedded electric heater element, not shown, is mounted on a handle 212 for rotational movement thereto by means of a pair of bearings 214. In this embodiment, a clamping member 216, pivoted at 218 to the iron rod, has a lever 220 extending at an angle therefrom so that the opening and closing movement of the clamping member is performed by the forefinger of the user. A spring 222 is mounted around the pivot 218 between the iron rod and the clamping member so that the latter is normally biased in the closing direction. A handle lever 224 having a forked end 226 is pivoted at 228 to the handle 212 and is pushed upward by a leaf spring 230 secured to the handle lever 224 at 232. The lengthwise edges of the handle lever 224 are partially bent down at right angles to form an inverted channel-like cross-section. The bottom of the channel at the right-hand end of the handle lever 224 are undercut to form a pair of parallel prongs 234 among which an end 236 of the leaf spring 230 extends rearwardly and upwardly to slightly project beyond the ends of the prongs 234. To the prongs 234 is rigidly secured a shaft 238 on which a rack bar 240, able to slide lengthwise along the shaft 238, is mounted. As shown in FIG. 13, the rack bar 240 is provided with two sets of teeth 242 and 244 facng each other and spaced from one another at a distance larger than the diameter of the pinion 246 mounted at the end of the iron rod 210, so that either set of teeth selectively engages with the pinion. As will be apparent from FIG. 12, the upper edge of the rack bar 240 is inclined rearwardly and is resiliently engaged by the end 236 of the leaf spring 230 so that the main part of the rack bar 240 is biased toward the handle 212. An electric cord 248 is connected to a pair of brushes 250 which are held in contact with respective slip rings 252 which in turn are connected to the heater element by lead wires 254.

In use, the user operates the lever 220 and clamps a lock of hair between the heated iron rod and the clamping member. Then the user presses the handle lever down to swing the rack bar about the pivot 228. When the rack bar has been displaced to the right as viewed in FIG. 13, the teeth 242 engage with the pinion so that the iron rod is turned counterclockwise during the downward stroke of the rack bar. If the user slides the rack bar along the shaft 238 to displace it to the left, then the iron rod is rotated in the reverse direction. Thus, with this arrangement, it is possible to turn the iron rod in either direction at the option of the user by a single sliding motion of the rack bar. This is particularly advantageous when the user has to curl his or her own hair without the assistance of a second person.

Figure 14:
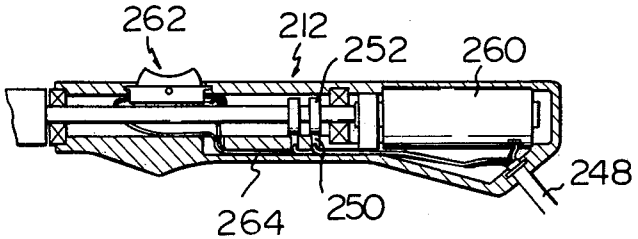
FIG. 14 is a cross-sectional view of a version of the embodiment of FIG. 12.

A modified version of the embodiment shown in FIGS. 12 and 13 is illustrated in FIG. 14, wherein only part of the device is represented. The curling iron in this version comprises a reversible electric motor 260 having a reduction gear mechanism, the output shaft of which is coupled to the iron rod. The electric motor is adapted to be controlled by a switch 262 connected thereto by lead wires 264. The switch has a first position in which the motor is turned in one direction, a second position in which the motor is rotated in the other direction, and a neutral position in which the power supply is interrupted. The iron rod and clamping mechanism are similar to those described with reference to the preceding embodiment and will not be described again. This version also enables the user to effect curling in any desired direction through just the actuation of the switch.

Figure 15:
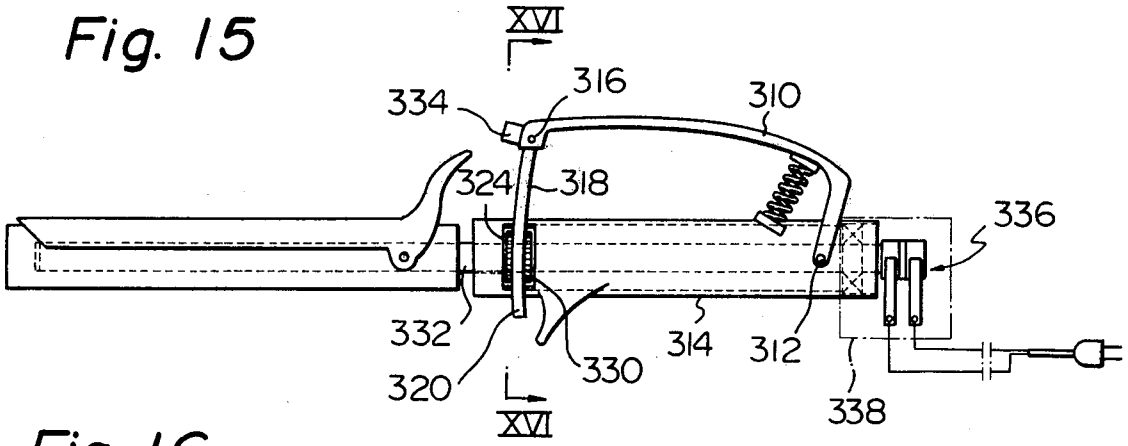
FIG. 15 is a front elevation of a still another embodiment.
Figure 17:
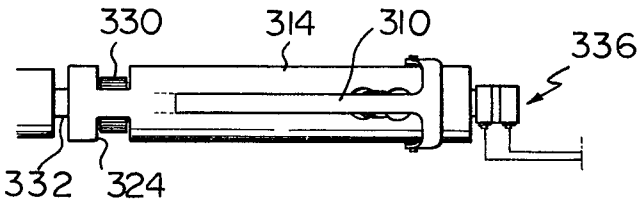
FIG. 17 is a top plan view of a part of the embodiment of FIG. 15.
Figure 16:
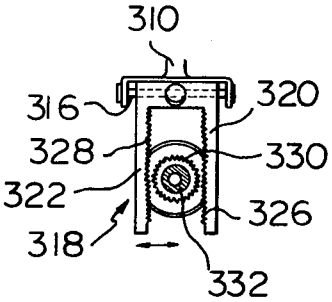
FIG. 16 is cross-sectional view taken along the line XVI—XVI of FIG. 15.

FIGS. 15 through 17, show another embodiment of the invention. This embodiment is similar to some extent to that described with reference to FIGS. 12 and 13 and, therefore, only the different parts will be described. The curling iron in this embodiment has an elongated H-shaped handle lever 310, the downwardly bent right-hand leg of the H being pivoted at 312 to the handle 314 adjacent the right hand end thereof, the other leg, similarly turned down, of the H carrying a slide shaft 316 on which a rack bar 318, able to slide lengthwise along the shaft 316, is mounted. The rack bar 318 has an inverted U-shaped configuration with its forked legs 320 and 322 extending across windows or slots 324 formed on the sides of the handle 314. Each leg 320 or 322 of the rack bar is provided with internal teeth 326 or 328 for engagement with a pinion 330 which is mounted on a shaft 332 of the iron rod in the region of the windows 324. The distance between the teeth 326 and 328 is so selected that on displacing the rack bar 318 along the slide shaft 316 toward any one of the extreme positions, either teeth 326 or 328 are selectively brought in mesh with the pinion. A projection 334 is provided on the rack bar to facilitate sliding of the rack bar. An electric connection 336 including a pair of slip ring and brush assemblies may be provided at the end of the iron rod shaft 332 and enclosed within a housing as shown diagramatically by a chain-line block 338 in FIG. 15.

As will be apparent from the foregoing description, this arrangement enables the user to rotate the iron rod in any desirable direction by displacement of the rack bar.

Figure 20:
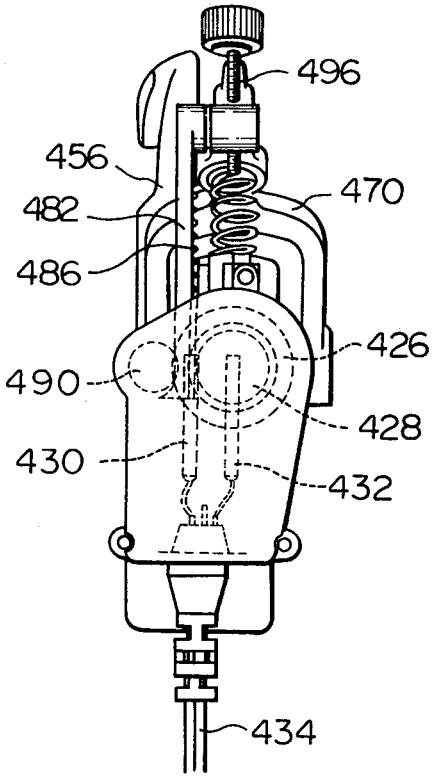
FIG. 20 is an end view of the embodiment of FIG. 18.
Figure 21:
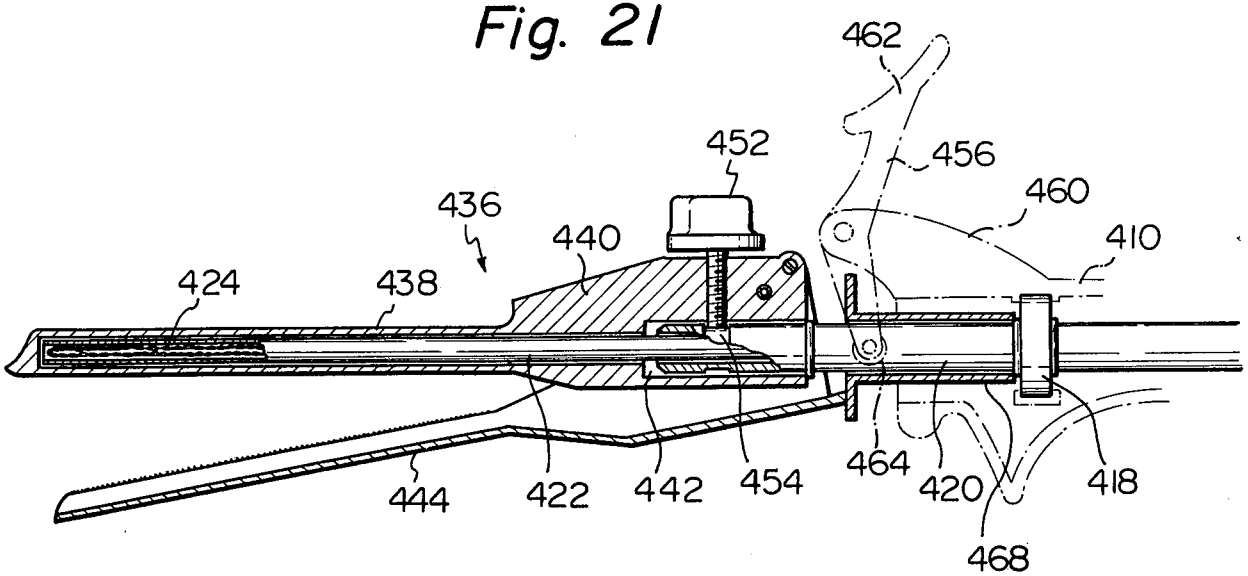
FIG. 21 is a cross-sectional view of a part of the embodiment of FIG. 18.
Figure 22:
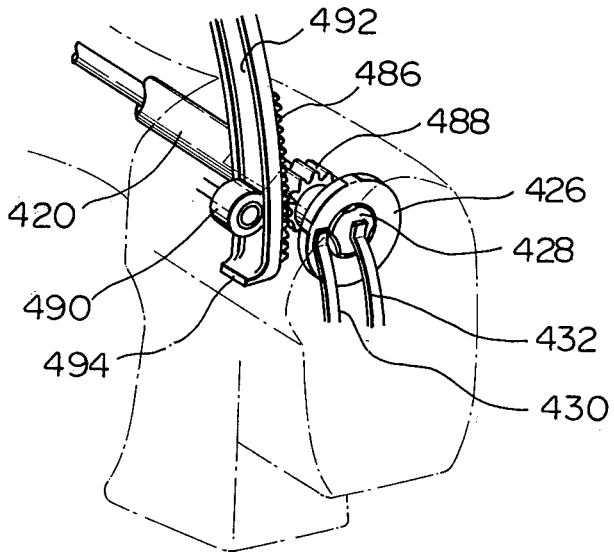
FIG. 22 is a perspective view of the rack/pinion assembly of the embodiment of FIG. 18.

FIGS. 18 to 23, show another preferred embodiment of the invention which is designed from the viewpoint of human-factor engineering to facilitate manipulation by the user's hand and fingers. A handle, generally indicated by the reference numeral 410, comprises two-part housings which are mating with each other and fastened together by screws, one of which is indicated at 412. The handle has downwardly extending projections 414 and 416 as shown adjacent the ends thereof to provide grip for the user's hand, the central portion thereof being slightly enlarged to fit the user's palm. Inside the handle there are mounted a pair of bearings 418 in which a rotary shaft 420 is mounted for rotation with respect to the handle. As will be apparent from FIG. 21, the rotary shaft 420 receives therein a heater tube 422 extending throughout the entire length of the shaft 420 and projecting beyond the left-hand end thereof. The heater tube 422 has a heater wire 424 (FIG. 21) which is electrically connected to slip rings 426 and 428 mounted on an end of the shaft in contact with brushes 430 and 432, which in turn are connected to an electric power supply cord 434 (FIGS. 18, 20 and 22).

The iron rod 436 consists of a tubular section 438 and a protuberant boss 440 integral therewith and has a first bore for receiving the heater tube 422 and an enlarged bore 442 accommodating an end of the rotary shaft 420. A clamping member 444 having a roughtly hemicyclic cross-section for a larger part thereof is pivoted at its end to the boss 440 of the iron rod at 446. The clamping member 444 is normally closed under the action of a pair of springs 448 each provided on an end of the pivot 446, with one end thereof secured to the boss 440 and the other end to the clamping member 444. A prong 450 is provided on the clamping member 444 for engagement with a slide sleeve, which will be described later.

The iron rod/clamping member assembly is clamped to the rotary shaft 420 by means of a clamping screw 452 screwed into a threaded hole of the boss 440 and engaging an annular groove 454 formed on the shaft 420 adjacent the end thereof. With this arrangement, the iron rod/clamping member assembly may be positioned at any desired angular relationship with respect to the rotary shaft as shown in FIGS. 23*a* and 23*b*. It is also possible to replace the assembly in use with another one. The clamping screw 452 may be provided with a clamping head, as shown, to facilitate fastening and release thereof.

The mechanism for opening and closing the clamping member 444 is the same in principle as that described with reference to FIGS. 1 through 4. The mechanism includes an actuating lever or bell-crank 456 pivoted at the middle thereof at 458 to a support 460 which is formed integral with the handle 410. A bow-shaped finger plate 462 is provided at the top of the actuating lever 456 in order to improve the grip of the finger. The lever 456 is provided at its lower end with a roller 464 adapted to engage with a flange 466 of a slide sleeve 468 mounted over the rotary shaft 420 for sliding movement therealong.

The driving mechanism for rotating the iron rod/-clamping member assembly comprises a bow-shaped handle lever 470 having a forked end 472 pivoted at 474 to the handle 410. The handle lever 470 is provided with a pair of spaced protuberances 476 and 478 to provide grip for the user's hand. A compression spring 480 is mounted between the embossed portions of the handle and the handle lever for moving the handle lever in the counterclockwise direction. The driving mechanism also includes a rack bar 482 pivoted at 484 at its upper end to the right-hand end of the handle lever 470. As will be more clearly understood from FIG. 22, a side of the rack bar 482 is provided with teeth 486 which are held in meshing engagement with a pinion 488 mounted on the rotary shaft 420 adjacent the slip rings 426 and 428 by means of a guide roller 490 which is journaled to the handle 410 to engage a lengthwise groove 492 provided on the other side of the rack bar. The rack bar 482 is provided at its lower end with a projection 494 for abutment against the guide roller 490, thereby preventing the rack bar from slipping out of the pinion as the rack bar is lifted. In the operative position of the handle lever, as illustrated by a chain line in FIG. 18, a considerable part of the rack bar extends within the handle housing, thereby substantially concealing the rack bar. This arrangement give the curling iron a neat appearance and, in addition, prevents foreign materials from being trapped or jammed in the rack/pinion assembly. An adjusting screw 496 may be threadingly engaged within a threaded hole on the handle lever so as to adjust the downward stroke of the handle lever, hence the angle of rotation of the rotary shaft 420.

In operation, the user places a lock of hair between the heated iron rod and clamping member and turns the actuating lever by his or her forefinger, causing the clamping member to be closed with the hair clamped as shown in FIG. 24. With his or her forefinger still on the actuating lever, the user then presses the handle lever down by other fingers, thereby rotating the iron rod/-clamping member assembly. As the hair is waved or curled, the user releases the actuating lever, or handle lever, or both, and thus moves the iron rod from the curled hair. The initial angular position of the iron rod/-clamping member assembly may be adjusted at the discretion of the user by releasing the clamping screw, turning the assembly to the desired angle with respect to the rotary shaft, and then fastening the clamping screw. Also, the assembly may be replaced with another assembly.

Referring to FIGS. 25 through 28, there is shown a further embodiment wherein the iron rod/clamping member assembly is mounted detachably and angular adjustably on the rotary shaft and wherein the actuating lever for opening and closing the clamping member is associated with the handle lever so that the movement of the actuating lever and the rotation of the rack bar is achieved by a single action of the handle lever. The iron rod/clamping member assembly with its clamping screw is the same as that shown in FIG. 18 and, therefore, will not be described again. A rotary shaft 510, having therein a heater tube, not shown, with a heater element connected to an electric cord 512, is mounted rotatably within a tubular handle 514 by means of suitable bearings, not shown. A torsional spring 518 is provided around the rotary shaft with one end thereof connected to the handle and the other end to the shaft. A slide sleeve 518 having a flange 520 is mounted on the shaft 510 and can slide therealong. A handle lever 520 and an actuating lever 522 is pivoted by a common pivot 524 to a support plate 526 secured to the side of the handle 514. The support plate 526 has at its upper end a stop 528 for limiting the upward movement of the handle lever and a stop pin 530 serving to limit the downward stroke of the handle lever. A compression spring 532 is mounted between spring retainers, one provided on the handle and the other on the handle lever. The actuating lever 522 has at its lower end a roller 534 adapted to be engaged with the flange 520 of the slide sleeve and is biased clockwise by means of a spring 536 placed between the actuating lever and the support plate. A stopper pin 538 is provided on the handle lever 514 in such a manner that in an inoperative position of the handle lever it abuts against the actuating lever 522 to turn the latter counterclockwise against the spring 536, thereby to cause the roller 518 to be disengaged from the flange of the slide sleeve which has been in contact with a prong of the hair clamping member.

At the end of the handle lever 520 opposite to the actuating lever 522 there is pivoted at 540 a rack bar 542 arranged to be engaged with a pinion 544 secured at the end of the rotary shaft 510 contiguous to the handle 514. As will be apparent from FIG. 27, the rack bar 542 is provided with teeth 546 for a major length thereof but the lower part 548 of the rack bar is not toothed so that during the initial course of a stroke of the rack bar there is no rotation of the pinion. As shown in FIGS. 27 and 28, a rack bar holder or retainer 550 having an L-shaped cross-section is secured to the handle to guide the rack bar in contact with the pinion as it is moved up and down by actuation of the handle lever. As illustrated in FIG. 28, the pinion 544 is provided with a recess 552 extending circumferentially through an angle to form a shoulder 554 which is adapted to engage with a lock pin 556 mounted on the handle 514. Thus, as the rotary shaft 510 is turned toward its initial rotational position by the spring force of the torsion spring 516, the shoulder 554 abuts against the pin 556, whereby the initial position of the pinion and, hence, of the iron rod/clamping member assembly is fixed. This position of the assembly may, of course, be altered at one's discretion, as described previously, by releasing the clamping screw of the assembly.

In use, a lock of hair is introduced between the iron rod and the bill-shaped clamping member and then the handle lever is pressed down. During the first stage of clockwise rotation of the handle lever, the pin 538 moves clockwise, thereby allowing the actuating lever 522 to move clockwise under the action of the spring 536 causing the roller 534 to be displaced to the left to push the flange of the slide sleeve against the prong of the clamping member, whereby the latter is closed to clamp the hair. As the handle lever is pressed down further, the teeth of the rack bar are brought into engagement with the pinion to drive it on rotation, whereby the iron rod/clamping member assembly is turned. After subjecting the clamped lock of hair to heat for a short period of time, for example, a few seconds, the user releases the force applied to the handle lever to allow the lever to move counterclockwise under the action of the spring 532, causing first the assembly to be turned in the reverse direction. Then the pin 538 comes in contact with the actuating lever 522, causing it to move counterclockwise, thereby releasing the flange of the slide sleeve from the clamping member, which, in turn, is opened under the action of the return spring. The curling iron may then be withdrawn from the curled hair. This embodiment is advantageous in that both clamping and curling operations of the hair can be performed by a single actuation of the handle lever. However, the wave or curl of the hair tends to be loosened due to the reverse rotation of the assembly, which takes place while the hair is clamped.

While the present invention is described hereinabove with reference to the specific embodiments thereof, considerable variations may be made in the construction of the parts within the spirit and scope of the appended claims.

I claim:

1. A curling iron comprising:

a handle;

an iron rod having a shaft mounted rotatably within said handle;

a clamping member pivoted to said iron rod for opening and closing movement with respect thereto for clamping a lock of hair against said iron rod;

means associated with said clamping member for opening and closing said clamping member;

means for rotating said shaft to twine the lock of hair to be curled around said iron rod;

means being provided between said iron rod and said clamping member for biasing the clamping member towards the normally open position, said means for moving the clamping member comprising a slide sleeve mounted axially slidably around said rotatable shaft between said clamping member and said handle, said slide sleeve having a flange at the end adjacent to said clamping member;

an actuating lever pivoted at its middle to said handle and having at its lower end a roller engageable with said flange; and at least one prong provided at an end of the clamping member in such a manner that engagement with said flange to move said slide sleeve lengthwise toward said clamping member, said flange pushes the prong to close the clamping member.

2. A curling iron as claimed in claim 1 wherein said means for rotating said shaft comprises a handle lever pivoted at an end thereof to said handle for movement between an inoperative position in which the other end thereof is remote from said handle and an operative position in which said other end comes close to the handle; a pinion mounted on said rotatable shaft; a rack bar connected to the other end of said handle lever for swinging movement about said pivot and provided with teeth for meshing engagement with said pinion to rotate said pinion; and a return spring mounted between said handle and handle lever for biasing said handle lever toward said inoperative position.

3. A curling iron as claimed in claim 1, wherein said means for rotating said rotatable shaft includes a reversible electric motor with a reduction gear mechanism housed within said handle, the output shaft of said reduction gear mechanism being coupled to said rotatable shaft, there being provided a switch for feeding electric power to said motor.

4. A curling iron as claimed in claim 1, wherein said means for moving the clamping member comprises a lever extending at an angle from said clamping member.

5. A curling iron comprising:

a handle;

an iron rod having a shaft mounted rotatably within said handle;

said iron rod having an axially extending bore in which an electric heater element is received;

said iron rod and said rotatable shaft being made as separate members, and said iron rod being detachably mounted on an end of the rotatable shaft;

said iron rod having at the end thereof adjacent to said end of the rotatable shaft a recess accommodating said end of the shaft, and said end of the rotatable shaft being fitted within said recess;

a clamping member pivoted to said iron rod for opening and closing movement with respect thereto for clamping a lock of hair against said iron rod; means associated with said clamping member for opening and closing said clamping member; and means for rotating said shaft to twine the lock of hair to be curled around said iron rod; and said iron rod being provided at the region of the recess with a threaded hole in which a clamping screw is engaged to clamp said iron rod to said rotatable shaft in such a manner that the angular position of said iron rod with respect to the rotatable shaft is adjusted at the discretion of the user.

6. A curling iron as claimed in claim 5, wherein said means for rotating said rotatable shaft includes a reversible electric motor with a reduction gear mechanism housed within said handle, the output shaft of said reduction gear mechanism being coupled to said rotatable shaft, there being provided a switch for feeding electric power to said motor.

7. A curling iron as claimed in claim 5, wherein said means for moving the clamping member comprises a lever extending at an angle from said clamping member.

8. A curling iron as claimed in claim 5, wherein said means for rotating said shaft comprises a handle lever pivoted at an end thereof to said handle for movement between an inoperative position in which the other end thereof is remote from said handle and an operative position in which said other end comes close to the handle; a pinion mounted on said rotatable shaft; a rack bar connected to the other end of said handle lever for swinging movement about said pivot and provided with teeth for meshing engagement with said pinion to rotate said pinion; and a return spring mounted between said handle and handle lever for biasing said handle lever toward said inoperative position.

9. A curling iron as claimed in claim 8, wherein an adjusting screw is provided on said handle lever adjacent said rack bar in order to adjustably limit the downward stroke of the rack bar.

10. A curling iron as claimed in claim 8, wherein said handle has a support extending therefrom to which said handle lever is pivoted, said support being provided with stops engagable with said handle lever for limiting the upward and downward movement of the handle lever.

11. A curling iron as claimed in claim 8, wherein there is provided means for pushing the rack bar against said pinion.

12. A curling iron as claimed in claim 11, wherein said pushing means is a pressor member having an L-shaped cross-section and secured to said handle, said member having a groove adapted to engage with the rack bar for guiding said rack bar therealong.

13. A curling iron as claimed in claim 11, wherein said pushing means is a guide roller mounted on said handle.

14. A curling iron as claimed in claim 13, wherein the rack bar is provided at its lower end with a projection for abutment against said roller thereby to limit the return stroke of the rack bar.

15. A curling iron as claimed in claim 8, wherein said pinion is located within the handle adjacent the rear end thereof and the lower part of said rack bar extends into the inside of the handle to provide a substantial concealment of the pinion-rack assembly.

16. A curling iron as claimed in claim 8 or claim 15, wherein said handle and handle lever are embossed at their ends to provide grip for the user's fingers.

17. A curling iron as claimed in claim 8, wherein said rack bar comprises a double-rack having two sets of teeth facing each other opposite said pinion, the distance between said two sets of teeth being selected larger than the outer diameter of said pinion, and wherein said rack bar is slidably mounted on said handle lever transversally of the handle lever, whereby on displacing the rack bar into one of the extreme positions thereof, any one set of teeth becomes selectively engaged with the pinion to reverse the rotational direction of the iron rod.

18. A curling iron as claimed in claim 17, wherein said pinion is mounted on said rotatable shaft outside of the handle and wherein the upper end of said rack bar is offset and is resiliently engaged by said biasing means so that the lower end of said rack bar is normally urged toward said handle.

19. A curling iron as claimed in claim 17, wherein said pinion is mounted on said rotatable shaft inside the handle and wherein the handle is provided with windows at the sides thereof in the region of said pinion so that the double-rack extends therethrough to engage with said pinion.

20. A curling iron as claimed in claim 8, wherein the lower part of said rack bar is left plain so that during the initial course of the downward stroke of the rack bar, the pinion remains disengaged from the rack bar.

21. A curling iron as claimed in claim 20, wherein a torsional spring is mounted around said rotatable shaft, with one end connected to the handle and other end to the rotatable shaft, for returning the shaft to its initial position when the pinion is disengaged from the rack bar.

22. A curling iron as claimed in any one of claims 20 and 21, wherein biasing means is provided between the iron rod and clamping member for pushing the clamping member to the normally open position and wherein said means for moving the clamping member comprises a slide sleeve mounted axially slidably on said rotatable shaft between said clamping member and handle, said sleeve having a flange at the end thereof adjacent to said clamping member, an actuating lever pivoted at an end thereof to the handle by a common pivot by which said handle lever is pivoted, said actuating lever being provided at its lower end with a roller adapted to engage with said flange, means for biasing said actuating lever toward said clamping member, at least a prong provided at an end of the clamping member in such a position as to close said clamping member as said prong is pushed by the flange, and means capable of contacting said actuating lever in the inoperative position of the handle lever to move said actuating lever against the action of said biasing means so as to disengage said roller from said flange, thereby to allow the clamping member to open, the arrangement being such that on operating the handle lever the clamping member is first closed and the rotatable shaft is then turned.

23. A curling iron as claimed in claim 22, wherein a releasing lever engaging said actuating lever is provided on said handle lever for moving said actuating lever in an operative position of the handle lever so as to open said clamping member in said operative position.

24. A curling iron as claimed in claim 5, wherein means is provided between said iron rod and clamping member for biasing the clamping member toward a normally closed position and wherein said means for moving clamping member comprises a slide sleeve mounted axially slidably around said rotatable shaft between said clamping member and handle, said slide sleeve having a flange at the end adjacent to said clamping member, an actuating lever pivoted at its middle to said handle and having at its lower end a roller engagable with said flange of the slide sleeve, and at least one prong provided at the end of the clamping member so that, on actuation of the actuating lever to bring said roller into engagement with said flange, thereby to move said slide sleeve toward said clamping member, said flange pushes the prong to open the clamping member.

25. A curling iron as claimed in claim 24, wherein a finger plate is provided at the upper end of the actuating lever so as to facilitate actuation by the user.

26. A curling iron as claimed in claim 1, wherein said iron rod has at the end thereof adjacent to said end of the rotatable shaft a recess accommodating said end of the shaft and wherein said end of the rotatable shaft is fitted within said recess.

27. A curling iron as claimed in any one of claims 26, 8 through 25, 5 and 1, wherein a slip ring/brush assembly is mounted on said rotatable shaft at the end opposite to said iron rod for electrically connecting said heat element with a power supply cord.

* * * * *